US008086393B2

(12) United States Patent
Lee et al.

(10) Patent No.: US 8,086,393 B2
(45) Date of Patent: Dec. 27, 2011

(54) PROVIDING ROAD INFORMATION INCLUDING VERTEX DATA FOR A LINK AND USING THE SAME

(75) Inventors: Joon Hwi Lee, Seoul (KR); Chu Hyun Seo, Seoul (KR); Young In Kim, Seoul (KR); Mun Ho Jung, Gyeonggi-do (KR); Moon Jeung Joe, Gyeonggi-do (KR); Dong Hoon Yi, Seoul (KR)

(73) Assignee: LG Electronics Inc., Seoul (KR)

( * ) Notice: Subject to any disclaimer, the term of this patent is extended or adjusted under 35 U.S.C. 154(b) by 946 days.

(21) Appl. No.: 11/419,178

(22) Filed: May 18, 2006

(65) Prior Publication Data

US 2006/0265118 A1 Nov. 23, 2006

Related U.S. Application Data

(60) Provisional application No. 60/681,971, filed on May 18, 2005, provisional application No. 60/759,963, filed on Jan. 19, 2006.

(30) Foreign Application Priority Data

Oct. 26, 2005 (KR) ..... 10-2005-0101414
Mar. 13, 2006 (KR) ..... 10-2006-0023213

(51) Int. Cl.
*G08G 1/00* (2006.01)

(52) U.S. Cl. ..... 701/117; 701/207; 701/208; 370/252; 370/349; 455/404.2

(58) Field of Classification Search ..... 701/117, 701/207, 208; 370/252, 349; 455/45, 423, 455/404.2, 456.1
See application file for complete search history.

(56) References Cited

U.S. PATENT DOCUMENTS

| | | | | |
|---|---|---|---|---|
| 4,907,159 | A * | 3/1990 | Mauge et al. | 701/117 |
| 5,649,297 | A * | 7/1997 | Park | 455/45 |
| 5,662,109 | A | 9/1997 | Hutson | |
| 5,933,100 | A | 8/1999 | Golding | |
| 6,067,499 | A * | 5/2000 | Yagyu et al. | 701/201 |
| 6,067,502 | A * | 5/2000 | Hayashida et al. | 701/209 |

(Continued)

FOREIGN PATENT DOCUMENTS

DE 19733179 A1 2/1998

(Continued)

OTHER PUBLICATIONS

International Search Report Dated Sep. 6, 2006 for Application No. PCT/KR2006/001834; 1 page.

(Continued)

*Primary Examiner* — Thomas Black
*Assistant Examiner* — Wae Louie
(74) *Attorney, Agent, or Firm* — Fish & Richardson P.C.

(57) ABSTRACT

A method of processing traffic information includes receiving link vertex information including a first identifier and vertex components that each reveal a position along a link. The first identifier enables a determination of a type of information that is included within the received link vertex information. The method also includes determining the type of information included within the received link vertex information based on the first identifier and identifying vertex components within the link vertex information only if the first identifier enables a determination that the received link vertex information includes at least one vertex component.

28 Claims, 10 Drawing Sheets

U.S. PATENT DOCUMENTS

| | | | | |
|---|---|---|---|---|
| 6,075,467 | A * | 6/2000 | Ninagawa | 340/995.14 |
| 6,085,137 | A * | 7/2000 | Aruga et al. | 701/51 |
| 6,101,443 | A * | 8/2000 | Kato et al. | 701/210 |
| 6,115,667 | A | 9/2000 | Nakamura | |
| 6,125,323 | A * | 9/2000 | Nimura et al. | 701/207 |
| 6,128,571 | A * | 10/2000 | Ito et al. | 701/201 |
| 6,232,917 | B1 | 5/2001 | Baumer | |
| 6,236,933 | B1 | 5/2001 | Lang | |
| 6,324,466 | B1 | 11/2001 | Vieweg | |
| 6,401,027 | B1 | 6/2002 | Xu | |
| 6,434,477 | B1 * | 8/2002 | Goss et al. | 701/117 |
| 6,438,490 | B2 | 8/2002 | Ohta | |
| 6,438,561 | B1 | 8/2002 | Israni | |
| 6,453,230 | B1 | 9/2002 | Geurts | |
| 6,477,459 | B1 * | 11/2002 | Wunderlich | 701/209 |
| 6,594,576 | B2 | 7/2003 | Fan et al. | |
| 6,597,982 | B1 * | 7/2003 | Schmidt | 701/117 |
| 6,610,321 | B2 | 8/2003 | Huang et al. | |
| 6,611,749 | B1 | 8/2003 | Berwanger | |
| 6,615,133 | B2 * | 9/2003 | Moskowitz et al. | 701/209 |
| 6,618,667 | B1 * | 9/2003 | Berwanger et al. | 701/117 |
| 6,633,808 | B1 | 10/2003 | Schulz et al. | |
| 6,687,611 | B1 | 2/2004 | Hessing et al. | |
| 6,741,932 | B1 * | 5/2004 | Groth et al. | 701/210 |
| 6,810,321 | B1 | 10/2004 | Cook | |
| 6,873,904 | B2 | 3/2005 | Yamamoto et al. | |
| 6,904,362 | B2 | 6/2005 | Nakashima et al. | |
| 6,924,751 | B2 | 8/2005 | Hempel et al. | |
| 6,970,132 | B2 | 11/2005 | Spilker, Jr. | |
| 6,990,407 | B1 | 1/2006 | Mbekeani et al. | |
| 6,995,769 | B2 * | 2/2006 | Ordentlich et al. | 345/520 |
| 6,996,089 | B1 * | 2/2006 | Ruf et al. | 370/349 |
| 7,013,983 | B2 | 3/2006 | Matsumoto et al. | |
| 7,047,247 | B1 | 5/2006 | Petzold et al. | |
| 7,106,219 | B2 | 9/2006 | Pearce | |
| 7,139,467 | B2 | 11/2006 | Seo et al. | |
| 7,139,659 | B2 | 11/2006 | Mbekeani et al. | |
| 7,188,025 | B2 | 3/2007 | Hudson | |
| 7,251,558 | B1 * | 7/2007 | McGrath | 701/117 |
| 7,269,503 | B2 | 9/2007 | McGrath | |
| 7,319,931 | B2 | 1/2008 | Uyeki et al. | |
| 7,355,528 | B2 * | 4/2008 | Yamane et al. | 340/995.13 |
| 7,373,247 | B2 * | 5/2008 | Park | 701/208 |
| 7,375,649 | B2 | 5/2008 | Gueziec | |
| 7,403,852 | B2 * | 7/2008 | Mikuriya et al. | 701/208 |
| 7,609,176 | B2 | 10/2009 | Yamane et al. | |
| 7,650,227 | B2 | 1/2010 | Kirk et al. | |
| 7,657,372 | B2 * | 2/2010 | Adachi et al. | 701/208 |
| 7,668,209 | B2 * | 2/2010 | Kim et al. | 370/537 |
| 7,701,850 | B2 | 4/2010 | Kim et al. | |
| 7,729,335 | B2 * | 6/2010 | Lee et al. | 370/349 |
| 7,739,037 | B2 * | 6/2010 | Sumizawa et al. | 701/208 |
| 7,825,825 | B2 * | 11/2010 | Park | 340/907 |
| 7,877,203 | B2 * | 1/2011 | Mikuriya et al. | 701/208 |
| 7,907,590 | B2 * | 3/2011 | Lee et al. | 370/349 |
| 7,940,741 | B2 * | 5/2011 | Lee et al. | 370/349 |
| 7,940,742 | B2 * | 5/2011 | Lee et al. | 370/349 |
| 2001/0028314 | A1 | 10/2001 | Hessing et al. | |
| 2003/0036824 | A1 | 2/2003 | Kuroda et al. | |
| 2003/0083813 | A1 | 5/2003 | Park | |
| 2003/0102986 | A1 | 6/2003 | Hempel et al. | |
| 2003/0179110 | A1 | 9/2003 | Kato | |
| 2004/0148092 | A1 | 7/2004 | Kim et al. | |
| 2004/0198339 | A1 * | 10/2004 | Martin | 455/423 |
| 2004/0246888 | A1 | 12/2004 | Peron | |
| 2004/0249560 | A1 | 12/2004 | Kim et al. | |
| 2005/0027437 | A1 | 2/2005 | Takenaga et al. | |
| 2005/0038596 | A1 | 2/2005 | Yang et al. | |
| 2005/0081240 | A1 | 4/2005 | Kim | |
| 2005/0107944 | A1 | 5/2005 | Hovestadt et al. | |
| 2005/0141428 | A1 | 6/2005 | Ishikawa | |
| 2005/0143906 | A1 | 6/2005 | Ishikawa et al. | |
| 2005/0198133 | A1 | 9/2005 | Karaki | |
| 2005/0206534 | A1 | 9/2005 | Yamane | |
| 2005/0209772 | A1 | 9/2005 | Yoshikawa | |
| 2005/0231393 | A1 | 10/2005 | Berger | |
| 2006/0139234 | A1 | 6/2006 | Tanaka | |
| 2006/0143009 | A1 | 6/2006 | Jost et al. | |
| 2006/0173841 | A1 | 8/2006 | Bill | |
| 2006/0178105 | A1 | 8/2006 | Kim | |
| 2006/0178807 | A1 | 8/2006 | Kato et al. | |
| 2006/0262662 | A1 | 11/2006 | Jung et al. | |
| 2006/0265118 | A1 * | 11/2006 | Lee et al. | 701/117 |
| 2006/0268721 | A1 * | 11/2006 | Lee et al. | 370/237 |
| 2006/0268736 | A1 * | 11/2006 | Lee et al. | 370/252 |
| 2006/0268737 | A1 | 11/2006 | Lee et al. | |
| 2006/0271273 | A1 | 11/2006 | Lee et al. | |
| 2006/0281444 | A1 | 12/2006 | Jung | |
| 2007/0005795 | A1 | 1/2007 | Gonzalez | |
| 2007/0019562 | A1 * | 1/2007 | Kim et al. | 370/252 |
| 2007/0122116 | A1 | 5/2007 | Seo et al. | |
| 2007/0167172 | A1 | 7/2007 | Kim et al. | |
| 2009/0125219 | A1 | 5/2009 | Lee et al. | |

FOREIGN PATENT DOCUMENTS

| | | | |
|---|---|---|---|
| DE | 197 33 179 | | 5/1998 |
| DE | 100 60 599 | | 6/2002 |
| DE | 101 01 349 | | 8/2002 |
| EP | 0 725 500 | | 8/1996 |
| EP | 1 041 755 | | 2/2000 |
| EP | 1 006 684 | | 6/2000 |
| EP | 1 030 475 | | 8/2000 |
| EP | 1 079 353 | | 2/2001 |
| EP | 1 376 512 | | 6/2003 |
| EP | 1 445 750 | | 11/2003 |
| EP | 1 460 599 | | 11/2003 |
| EP | 1150265 | B1 | 10/2006 |
| EP | 1 049 277 | B1 | 2/2007 |
| GB | 2 342 260 | | 4/2000 |
| JP | 09-062884 | | 3/1997 |
| JP | 11-160081 | | 6/1999 |
| JP | 2001-082967 | | 3/2001 |
| JP | 2001-272246 | | 10/2001 |
| JP | 2004-164373 | | 6/2004 |
| JP | 2004-186741 | | 7/2004 |
| JP | 2004-295736 | | 10/2004 |
| JP | 2004-355662 | | 12/2004 |
| JP | 2005-056061 | | 3/2005 |
| KR | 10-1999-0025959 | | 4/1999 |
| KR | 1019990068262 | A | 9/1999 |
| KR | 10-2001-0016252 | | 3/2001 |
| KR | 10-2003-0034915 | | 10/2001 |
| KR | 10-2002-0017535 | | 3/2002 |
| KR | 10-2003-0037455 | | 5/2003 |
| KR | 10-2004-0033141 | | 4/2004 |
| KR | 10-2004-0084374 | | 10/2004 |
| KR | 10-2004-0084508 | | 10/2004 |
| KR | 10-2005-0037776 | | 4/2005 |
| KR | 10-2005-0062320 | | 6/2005 |
| KR | 10-2006-0002468 | | 1/2006 |
| KR | 100565089 | B1 | 3/2006 |
| KR | 10-2006-0063563 | | 6/2006 |
| KR | 10-2006-0063629 | | 6/2006 |
| KR | 10-2006-0076574 | | 7/2006 |
| WO | WO 98/24079 | | 6/1998 |
| WO | WO 98/26395 | | 6/1998 |
| WO | WO 98/26396 | | 6/1998 |
| WO | WO 98/41959 | | 9/1998 |
| WO | WO 00/30058 | | 5/2000 |
| WO | WO 00/36771 | | 6/2000 |
| WO | WO 00/39774 | | 7/2000 |
| WO | WO 01/06478 | | 1/2001 |
| WO | WO 01/18767 | | 3/2001 |
| WO | WO 01/18768 | | 3/2001 |
| WO | WO 01/31497 | | 5/2001 |
| WO | WO 02/01532 | | 1/2002 |
| WO | WO 02/13161 | | 2/2002 |
| WO | WO 02/082402 | | 10/2002 |
| WO | W02004036545 | A1 | 4/2004 |
| WO | WO 2005/020576 | | 3/2005 |

OTHER PUBLICATIONS

International Search Report Dated Oct. 19, 2006 for Application No. PCT/KR2006/001835; 2 pages.

International Search Report Dated Sep. 27, 2006 for Application No. PCT/KR2006/001837; 2 pages.

International Search Report Dated Aug. 28, 2006 for Application No. PCT/KR2006/001860; 1 page.
International Search Report Dated Oct. 19, 2006 for Application No. PCT/KR2006/002068; 1 page.
European Search Report Dated Sep. 30, 2008 for Application No. 06747474.2; 8 pages.
European Search Report Dated Sep. 25, 2008 for Application No. 06747435.3; 8 pages.
European Search Report Dated Aug. 11, 2008 for Application No. 06747441.1; 8 pages.
European Search Report Dated Oct. 15, 2008 for Application No. 06747434.6; 8 pages.
European Search Report Dated Aug. 14, 2008 and Jul. 28, 2008 for Application No. 06747433.8; 11 pages.
European Search Report dated Jul. 30, 2008 for Application No. 06747437.9, 9 pages.
International Search Report dated Aug. 28, 2006 for Application No. PCT/KR2006/001836, 1 page.
International Search Report dated Sep. 6, 2006 for Application No. PCT/KR2006/001843, 9 pages.
International Search Report dated Apr. 25, 2007 for Application No. PCT/KR2007/000324, 7 pages.
International Search Report dated May 8, 2007 for Application No. PCT/KR2007/000318, 7 pages.
Office Action dated Feb. 24, 2009 for U.S. Appl. No. 11/419,127, 37 pages.
Office Action dated Apr. 3, 2009 for U.S. Appl. No. 11/419,164, 44 pages.
European Search Report dated Jun. 30, 2008 for Application No. 06747440.3, 10 pages.
International Search Report dated Aug. 28, 2006 for Application No. PCT/KR2006/001859, 1 page.
Korean Office Action dated Nov. 15, 2006 for Application No. KR 10-2005-0086890, 3 pages.
European Search Report dated Nov. 17, 2008 for Application No. 06747441.1, 7 pages.
European Search Report dated Sep. 4, 2009 for Application No. 09165793.2.-2215, 9 pages.
Office Action issued in U.S. Appl. No. 11/419,095 dated Jul. 31, 2009, 30 pages.
Office Action issued in U.S. Appl. No. 11/419,127 dated Jul. 22, 2009, 18 pages.
Office Action issued in U.S. Appl. No. 11/419,164 dated Oct. 1, 2009, 30 pages.
Office Action Issued in U.S. Appl. No. 11/424,111 dated Aug. 11, 2009, 14 pages.
Tristan Ferne BBC Research & Development, TPEG C++ Library Documentation (v2.0), Mar. 20, 2002, 10 pages.
U.S. Office Action dated Jul. 31, 2009 for U.S. Appl. No. 11/419,095, 30 pages.
Tristan Ferne, BBC Research & Development, TPEG C++ Libraray Documentation (v2.0), dated Mar. 20, 2002, 10 pages.
U.S. Office Action for U.S. Appl. No. 11/424,111, dated Aug. 11, 2009, 14 pages.
European Search Report dated Oct. 23, 2009 for Application No. 09170601.0-2215.
European Search Report dated Oct. 26, 2009 for Application No. 09170878.4-2215.
Notice of Allowance issued in U.S. Appl. No. 11/419,095 dated Dec. 3, 2009.
Office Action issued in U.S. Appl. No. 11/419,127 dated Dec. 14, 2009.
"TPEG TEC Application Specification," Working Document, Development Project, Mobile.Info, Mar. 9, 2006, 30 pages.
"Traffic and Travel Information (TTI)—TTI via Transport Protocol Experts Group (TPEG) Extensible Markup Language (XML_—Part 1: Introduction, common data types and tpegML," Technical Specification, ISO/TS 24530-1, First Edition, Apr. 15, 2006, 20 pages.
Bev Marks, "TPEG-Standardized at Last," Oct. 2005.
European Office Action and Search Report issued in Application No. 09159699.9-2215 dated Jun. 26, 2009.
European Search Report dated Jun. 20, 2008 for Application No. 06747461.9, 8 pages.
International Search Report dated Sep. 6, 2006 for Application No. PCT/KR2006/2002012, 2 pages.
Office Action issued in U.S. Appl. No. 11/419,187 dated Feb. 19, 2010, 30 pages.
Office Action issued in U.S. Appl. No. 11/424,111 dated Feb. 3, 2010, 21 pages.
Office Action issued in U.S. Appl. No. 11/419,164 dated Mar. 11, 2010, 32 pages.
U.S. Notice of Allowance and Fee(s) Due for U.S. Appl. No. 11/419,127 dated Dec. 13, 2010, 17 pages.
U.S. Office Action dated Jun. 7, 2010 for U.S. Appl. No. 11/419,127, 24 pages.
U.S. Office Action dated Jul. 1, 2010 for U.S. Appl. No. 11/914,682, 11 pages.
U.S. Notice of Allowance dated Jul. 21, 2010 for U.S. Appl. No. 11/419,164, 15 pages.
U.S. Notice of Allowance dated Aug. 9, 2010 for U.S. Appl. No. 11/419,095, 17 pages.
U.S. Notice of Allowance and Fee(s) Due for U.S. Appl. No. 11/419,127 dated Aug. 23, 2010, 17 pages.
U.S. Notice of Allowance and Fee(s) Due for U.S. Appl. No. 11/419,164 dated Sep. 8, 2010, 11 pages.
U.S. Office Action for U.S. Appl. No. 11/419,187 dated Aug. 13, 2010, 16 pages.
U.S. Notice of Allowance dated Apr. 8, 2011 for U.S. Appl. No. 11/624,424, 9 pages.
U.S. Office Action dated May 6, 2011 for U.S. Appl. No. 11/424,111, 20 pages.
European Search Report dated Nov. 4, 2009 issued in European Application No. 09171279.4-2215, 7 pages.
Korean Notice of Allowance dated Aug. 22, 2011 for Application No. 10-2005-0086891, with English Translation, 3 pages.

* cited by examiner

FIG. 2D

```
<tpeg_loc_container>: =:
  <loc41>,                    : Default language for TPEG -Loc Component
  m*<tpeg-loc-component()>;       : TPEG -Loc component
```

FIG. 2E

```
<tpeg_loc_component(00)>: = : Location co-ordinates component
  <intunti>(id),                  : identifier, id=00 hex
  <intunli>(n),                   : component data length in byte (n)
  <loc01>,                        : Location type, TPEG table loc01
  m*<co-ordinates component()>; : Location co-ordinates component
```

FIG. 2F

```
<co-ordinates_component(00)>: =    : Road type list
  <intunti>(id),                  : identifier, id=00 hex
  <intunti>(n),                   : component data length in byte (n)
  m*<roadtype_component()>; : Road type component
```

```
<roadtype_component(00)>: =: Road type list component template
  <intunti>(id),                  : identifier, id=00 hex
  <intunti>(n),                   : component data length in byte (n)
  <loc42>;                        : Road type, TPEG table loc42
```

FIG. 2G

```
<co-ordinates_component(01)>:=    : WGS84
  <intunti>(id),              : identifier, id=01 hex
  <intunti>(n),               : component data length in byte (n)
  <intunloi>(longitude),      : Longitude (in 10 micro-degrees units)
  <intunlo>(latitude),        : Latitude (in 10 micro-degrees units)
  m*<WGS84_component>;        : WGS 84 component
```

```
<WGS84_component(00)>:=Expansion
  <intunti>(id),              : identifier, id=00 hex
  <intunti>(n),               : component data length in byte (n)
  <intunli>;                  : Radius of circle (in meters * 10)
```

FIG. 2H

```
<co-ordinates_component(03)>:=    : Descriptor
  <intunti>(id),              : identifier, id=03 hex
  <intunti>(n),               : component data length in byte (n)
  <loc03>,                    : Descriptor type
  <short_string>(name):       Descriptor
  m*<descriptor_component>;   : Descriptor components
```

```
<descriptor_component(00)>:= Direction type
  <intunti>(id),              : identifier, id=00 hex
  <intunti>(n),               : component data length in byte (n)
  <loc02>;                    : Direction type, TPEG table loc02
```

FIG. 2I

```
<co-ordinates_component(10)>: =    : Link ID
  <intunti>(id),              : identifier, id=10 hex
  <intunti>(n),               : component data length in byte (n)
  <loc43>,                    : ID type
  m*<link_component>;         : link component
```

```
<Link_component(00)>: = Expansion
  <intunti>(id),              : identifier, id=00 hex
  <intunti>(n),               : component data length in byte (n)
  <intunlo>;                  : Link ID
```

FIG. 3A

```
<link_info_component(01)>: =: Link information component
  <intunti> (id),             : identifier, id = 01 hex
  <intunli> (n),              : data length in byte (n)
  m*<link_info_sub_component()>;: link information subcomponent
```

FIG. 3C

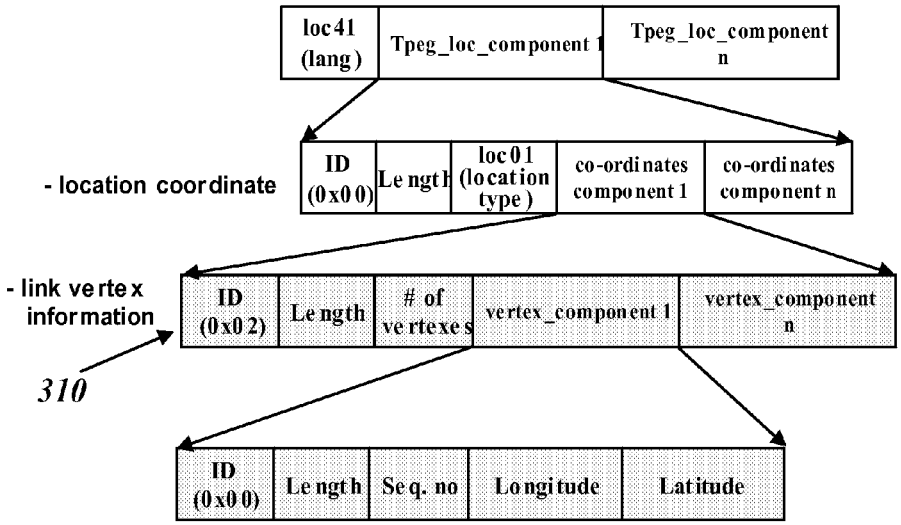

FIG. 3D

```
<co-ordinates_component(02)>:=: vertex information
  <intunti>(id),              : identifier, id=02 hex
  <intunti>(n),               : component data length in byte (n)
  <intunti>,                  : the number of vertexes (not greater than 23)
  m*<Vertex_component>        : Vertex component
```

```
<vertex_component(00)>:=: vertex (wgs84)
  <intunti>(id),              : identifier, id=00 hex
  <intunti>(n),               : component data length in byte (n)
  <intunti>,                  : order of vertex, (starting from 0)
  <intunlo>(longitude),       : Longitude(in 10 micro-degrees units)
  <intunlo>(latitude);        : Latitude(in 10 micro-degrees units)
```

yyy

*Link Information Table*

| Link ID | Number Of Vertexes | Link Name | Address of Vertex |
|---|---|---|---|
| 0000001 | n1 | Name 1 | Addr 1 |
| 0000002 | n2 | Name 2 | Addr 2 |
| ⋮ | ⋮ | ⋮ | ⋮ |
| nnnnnnn | nk | Name k | Addr k |
| | | | |

PROVIDING ROAD INFORMATION INCLUDING VERTEX DATA FOR A LINK AND USING THE SAME

CROSS-REFERENCE TO RELATED APPLICATIONS

The present application claims priority from U.S. provisional application Nos. 60/681,971 filed May 18, 2005, which is titled "Traffic information signal and method and apparatus for providing the signal," and 60/759,963 filed Jan. 19, 2006, which is titled "Traffic information providing method," the entire contents of which are incorporated herein by reference. The present application also claims priority from Korean application Nos. 10-2005-0101414 filed Oct. 26, 2005, and 10-2006-0023213 filed, Mar. 13, 2006, the entire contents of which are incorporated herein by reference.

BACKGROUND

1. Field

This disclosure relates to providing traffic information of a road, particularly, information relating to the road.

2. Description of the Related Art

With the advancement in digital signal processing and communication technologies, radio and TV broadcasts are being digitalized. Digital broadcasting enables provision of various information (e.g., news, stock prices, weather, traffic information, etc.) as well as audio and video content.

SUMMARY

In one general aspect, a method of processing traffic information is provided. The method includes receiving link vertex information including a first identifier and vertex components that each reveal a position along a link. The first identifier enables a determination of a type of information that is included within the received link vertex information. The method also includes determining the type of information included within the received link vertex information based on the first identifier and identifying vertex components within the link vertex information only if the first identifier enables a determination that the received link vertex information includes at least one vertex component.

Implementations may include one or more additional features. For instance, receiving link vertex information may include receiving an indicator of a number of vertex components that are specified by the link vertex information. The number of vertex components included in the link vertex information may correspond to the number of vertex components indicated by the indicator. The received indicator may specify that the link vertex information includes only one vertice, and the identified vertex component consists of a single vertex component that reveals a single position along the link other than a start point and end point. The received indicator may specify that the link vertex information includes more than one vertice, and the identified vertex component includes multiple vertex components that correspondingly reveal multiple positions along the link other than start point and end point of the link. The identified vertex components may each be associated with a sequence value configured to order the vertex components along the link. Receiving link vertex information may include receiving the sequence value.

The method may also include receiving information corresponding to a message management structure including information corresponding to a generation time of information reflected in the link vertex information. The generation time included within the received message management structure may relate to a plurality of vertex components. The generation time included within the received message management structure may relate to a plurality of message component structures that correspond to a vertex component. Each message component structure may further include an identifier specific to the type of information included in the message management structure and the first identifier may be an identifier, in a message component structure, specifying the inclusion of a vertex component. The vertex component may include, for each vertex component, a sequence value configured to order the vertex components along the link.

In the method, the vertex component may identify a longitude and latitude associated with a position along a link other than a start point and an end point. The vertex component may include a text descriptor associated with the vertex component. Receiving link vertex information may include decoding the link vertex information such that the received link vertex information is decoded link vertex information. Receiving link vertex information may include identifying a longitude of the vertex position information and identifying a latitude of the vertex position. The processing device may be configured to determine link vertex information is configured to determine a vertex position from information other than longitude, latitude, or sequence. The position may be a position along the link other than a start point or an end point of the link.

In another general aspect, a traffic information communication device is provided. The device includes a data receiving interface configured to receive link vertex information including a link vertex identifier that identifies the received information as including at least one vertex component. The data receiving interface also includes an indication of a number of vertex components that are specified by the link vertex information and a number of vertex components corresponding to the indication. At least one of the vertex components includes a vertex component identifier that identifies the vertex component as a single one of the vertex components included within the link vertex information, vertex position information identifying a position of a vertex specified by the vertex component as including a position along a link. The device also includes a processing device configured to process the link vertex information received from the data receiving interface. The process includes determining a type of information included within the received link vertex information and identifying a vertex position specified by the vertex components based on the received information.

Implementations may include one or more additional features. For instance, the vertex position information may indicate a position along a path other than the shortest path between the endpoints of the link. The link vertex identifier may reflect that a single vertex is specified by the link vertex information, and the number of vertex components correspondingly include a single vertex component. The vertex position information may correspond to at least a two-dimensional position where at least one positional dimension corresponds to time.

In the device, a set of values may corresponding to the first dimension may be a function of a set of values corresponding to time. The vertex position information may correspond to more than a two-dimensional position. One dimension may be associated with elevation. The processing device may be configured to decode information identifying a longitude of the vertex position and information identifying a latitude of the vertex position.

Also, in the device, the link vertex information may include a data length of information used to reveal the vertex position along the link. The processing device may be configured to determine a vertex position from information other than longitude, latitude, or sequence. The processing device may be configured to receive link vertex information including information corresponding to a version number of information reflected in the link vertex information. The version number may be associated with a specific syntax of the data where any one of multiple syntaxes may be used.

The processing device may be further configured to receive information corresponding to a message management structure including information corresponding to a generation time of information reflected in the link vertex information. The positions may be a position along the link other than a start point or an end point of the link. The processing device may be configured to determine the type of information included within the received link vertex information based on the link vertex identifier and the vertex component identifier. The processing device may be configured to identify the vertex position only if the link vertex identifier and the vertex component identifier enable a determination that the received link vertex information includes at least one vertex component In a further general aspect, a method of processing traffic information is provided. The method includes means for receiving link vertex information including a first identifier and vertex components that each reveal a position along a link. The first identifier enables a determination of a type of information that is included within the received link vertex information. The method also includes means for determining the type of information included within the received link vertex information based on the first identifier and means for identifying vertex components within the link vertex information only if the first identifier enables a determination that the received link vertex information includes at least one vertex component.

The details of one or more implementations are set forth in the accompanying drawings and the description below. Other features will be apparent from the description and drawings, and from the claims.

BRIEF DESCRIPTION OF THE DRAWINGS

FIGS. 2D to 2I show syntaxes of information elements shown FIG. 2C;

FIG. 3A illustrates a road information component;

FIG. 3C shows transfer format of a congestion traffic information (TPEG-CTT) message by focusing on a component carrying information relating to a shape of a road link in accordance with another implementation;

FIG. 3D shows syntax of the element, shown in FIG. 3C, carrying information on a shape of a road link;

DETAILED DESCRIPTION

One such use for digital broadcasts is to satisfy an existing demand for traffic information. Proposals that involve the use of digital broadcasts for this purpose contemplate the use of standardized formatting of traffic information to be broadcast. This approach may be used to enable the use of traffic information receiving terminals made by different manufacturers, which each could be configured to detect and interpret traffic information broadcast in the same way.

Figure 1:
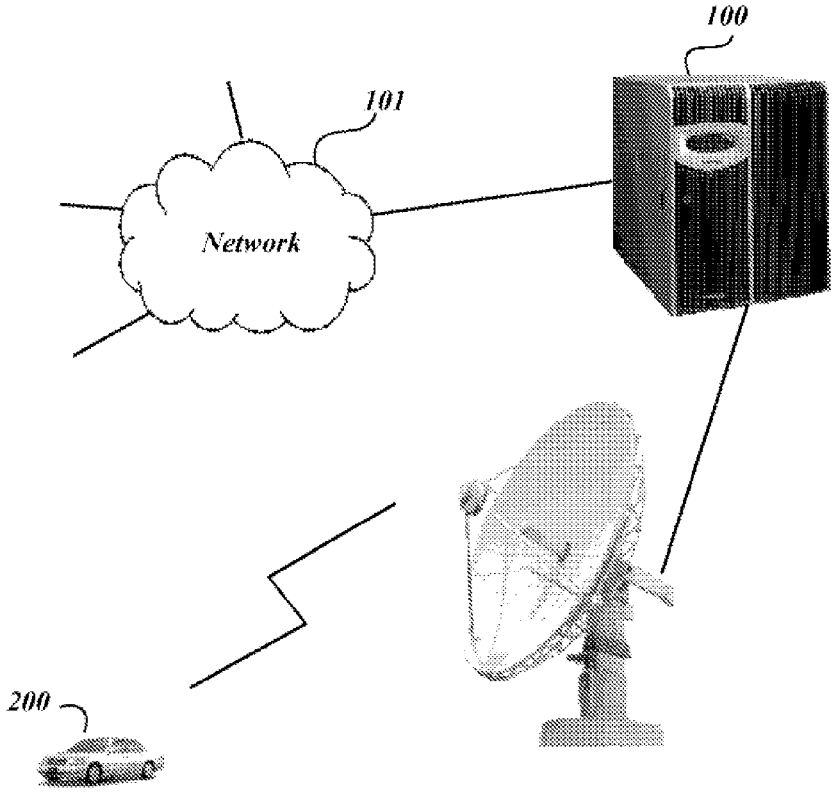
FIG. 1 illustrates a network for providing traffic information.

FIG. 1 is a diagram showing an overview of a network for traffic information according to an implementation. Referring to FIG. 1, by way of example, a traffic information providing server 110 of a broadcasting station may reconfigure various congestion traffic information aggregated from a user's input, another server over the network 101, or a probe car, and then may broadcast the reconfigured information by radio so that a traffic information receiving terminal, such as a navigation device installed to a car 200, may receive the information.

Figure 2A:
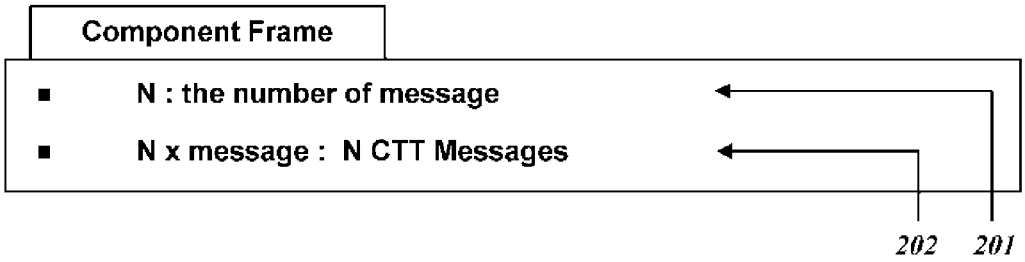
FIG. 2A illustrates a syntax relating to a part of a component frame including the traffic information.

The congestion traffic information broadcast by the traffic information providing server 100 via radio waves may be transmitted as a component frame. The component frame, as shown in FIG. 2A, comprises a number field of messages included in the component frame 201, and a sequence 202 of congestion information messages as many as the messages included in the number field 202. Hereafter, the congestion information message is referred to as a Transport Protocol Expert Group (TPEG)—congestion and travel-time information (CTT) message.

Figure 2B:
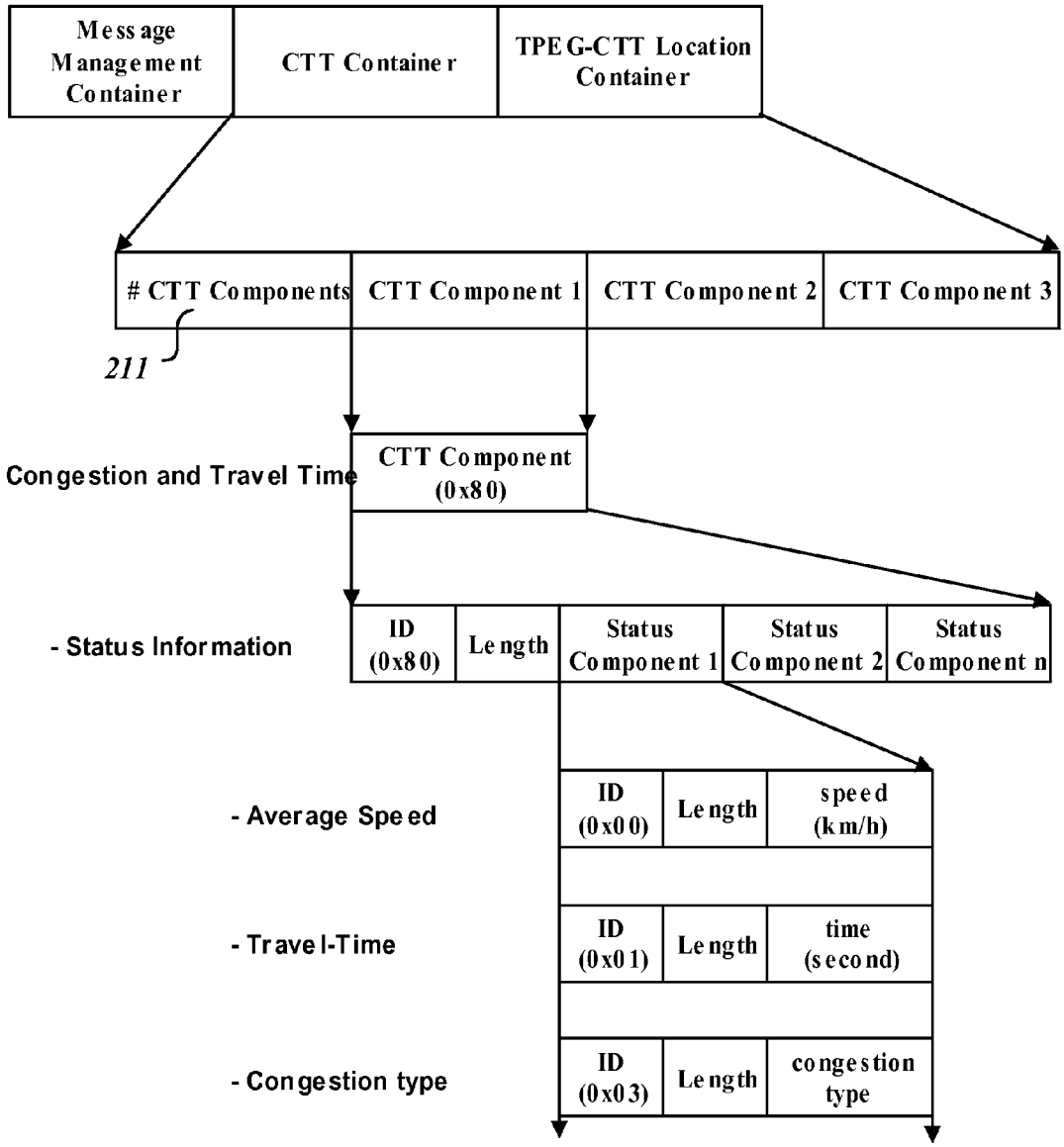
FIG. 2B illustrates a transmission format of a congestion traffic information (TPEG-CTT) message by focusing on a status component which includes road traffic information.
Figure 2C:
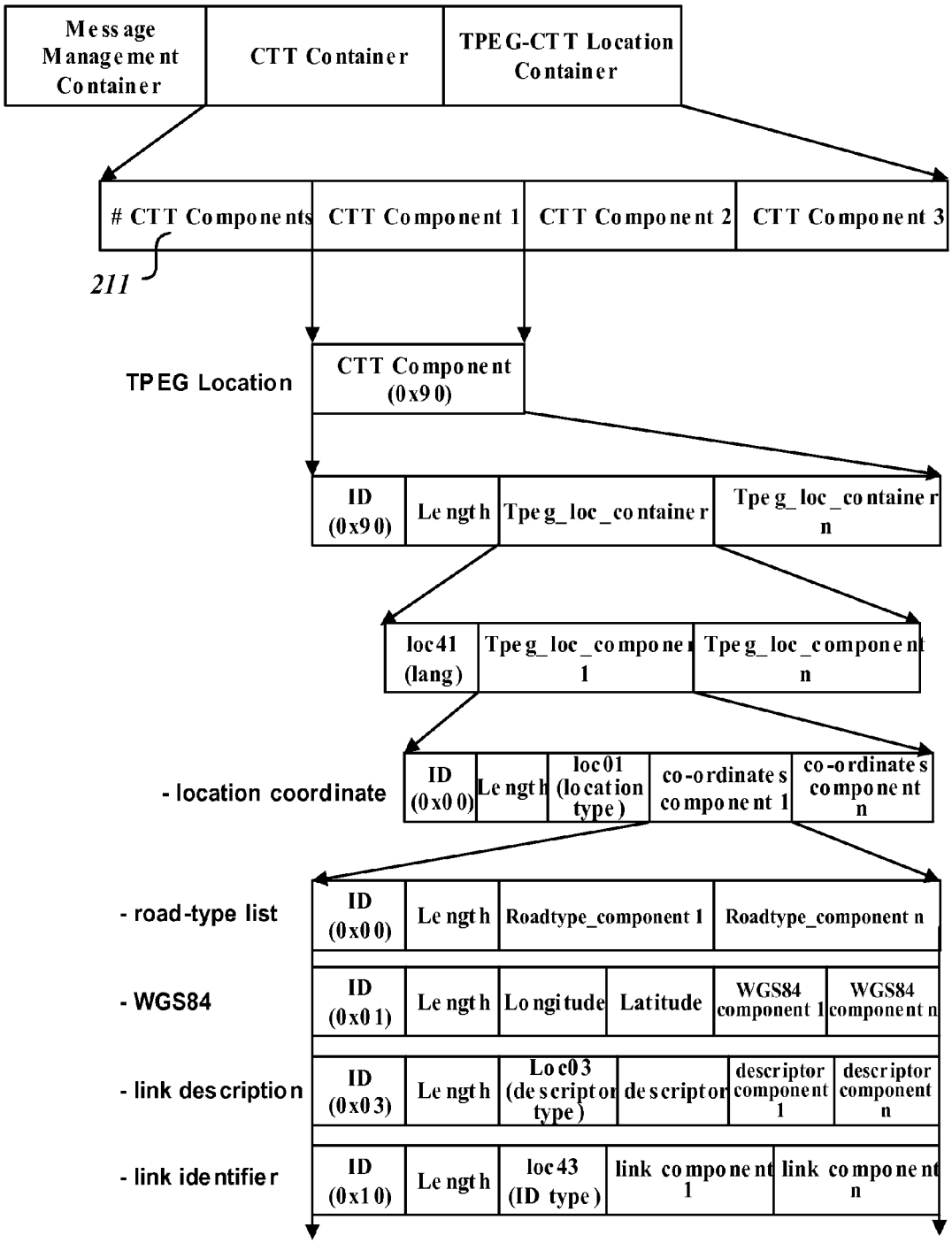
FIG. 2C illustrates the transmission format of the congestion traffic information (TPEG-CTT) message by focusing on a coordinates component which includes road link information.

In various implementations, one message segment of the sequence 202, that is, the TPEG-CTT message may comprise a message management container carrying information relating to date, time, and message generation time, a CTT container, and a TPEG-CTT location container, as shown in FIGS. 2B and 2C. At the front of the CTT container, a number field of CTT components 211 may be included. The number field of CTT components 211 may belong to the CTT container and the TPEG-CTT location container. Subsequent to the number field 211, CTT components corresponding to the number may be arranged.

In various implementations, if a CTT component includes traffic flow information, the CTT component has an identifier (ID) of 0×80 as shown in FIG. 2B. The CTT component may comprise one or more status components. The status component carries information relating to a section (link) average speed (a status component including an ID of 0×00), a link travel-time (a status component including an ID of 0×01, and congestion type (a status component including an ID of 0×03). In the description, specific IDs are described as assignments to structures associated with specific information. The actual value of an assigned ID (e.g., 80 h) is exemplary, and different implementations may assign different values for specific associations or circumstances. Thus, the CTT component may be used to provide various different types of data that may be signaled based on an identifier. For example, FIG. 2B and FIG. 2C illustrate a component with an identifier of 0×80 and 0×90 signaling, respectfully, status and location information.

In various implementations, if a CTT component includes link location information, the CTT component has an ID of 0×09 as shown in FIG. 2C. Likewise, the CTT component may comprise one or more TPEG-CTT location sub-containers Tpeg_loc_container illustratively structured as shown in FIG. 2D. Each TPEG-CTT location sub-container may comprise one or more TPEG-CTT location components Tpeg_loc_container. Each TPEG-CTT location component may include one or more location components including an ID of 0×00 that is illustratively structure as shown in FIG. 2E. The location component may comprise one or more coordinates components. The coordinates component may carry information relating to road link(s), that is, link(s) which may be the target of the traffic flow information included in the status component as described earlier. The link information may carry information relating to a road type such as high way and state road (a coordinates component including an ID of 0×00), coordinates information which may be expressed in WGS 84 (a coordinates component including an ID of 0×01), link description information (a coordinate component including an ID of 0×03), and link identifying information (a coordinates component including an ID of 0×10), and the like.

The information on load shape may be organized and transmitted, for example, in the form of FIG. 2F. The coordinates information may be organized and transmitted, for example, in the form of FIG. 2G. The link description information may be organized and transmitted, for example, in the form of FIG. 2H and the link identifying information may be organized and transmitted, for example, in the form of FIG. 2I.

The server 100 may reconfigure current road congestion information, as shown in FIGS. 2A to 2I, based on the current traffic information aggregated through various paths and its traffic information stored in database, and may transmit the reconfigured information to the traffic information receiving terminal by radio.

In one implementation, when the traffic information about each road link is provided, the traffic information receiving terminal may search a corresponding road section (hereafter, referred to as a "section" or a "link") on its held electronic map and may represent the received traffic information using color, graphic, or text. If the traffic information receiving terminal is without an electronic map, such that it cannot represent the received traffic information on such an electronic map, it may nevertheless represent the received traffic information using graphic or text. Specifically, the graphical representation may present the road as a linear form regardless of the actual type.

According to an implementation, the server 100 may aggregate and may provide the traffic information relating to, for example, a new building, a shut-down road, or route or area, or a path change of the roads (hereafter, referred to as a road change), to a traffic information receiving terminal. In addition, the information about road shape may also provided for a traffic information receiving terminal not equipped with electronic map. Thus the system is capable of informing a user when a new road is configured, and/or an existing road is reconfigured to change its shape and/or shut down, such as, for example, due to construction.

In the following, an implementation of method of providing the road change or road shape information is explained in detail.

To provide the road change or road shape information, the server 100 may generate a road information component 300 Link_info_component configured as shown in FIG. 3A, and may load the road information component in the TPEG-CTT sub-container Tpeg_loc_container to transmit. The road information component 300 may be assigned an ID, e.g., 0×01 different from the ID 0×00 of the coordinates component.

Each road information component

Figure 3B:
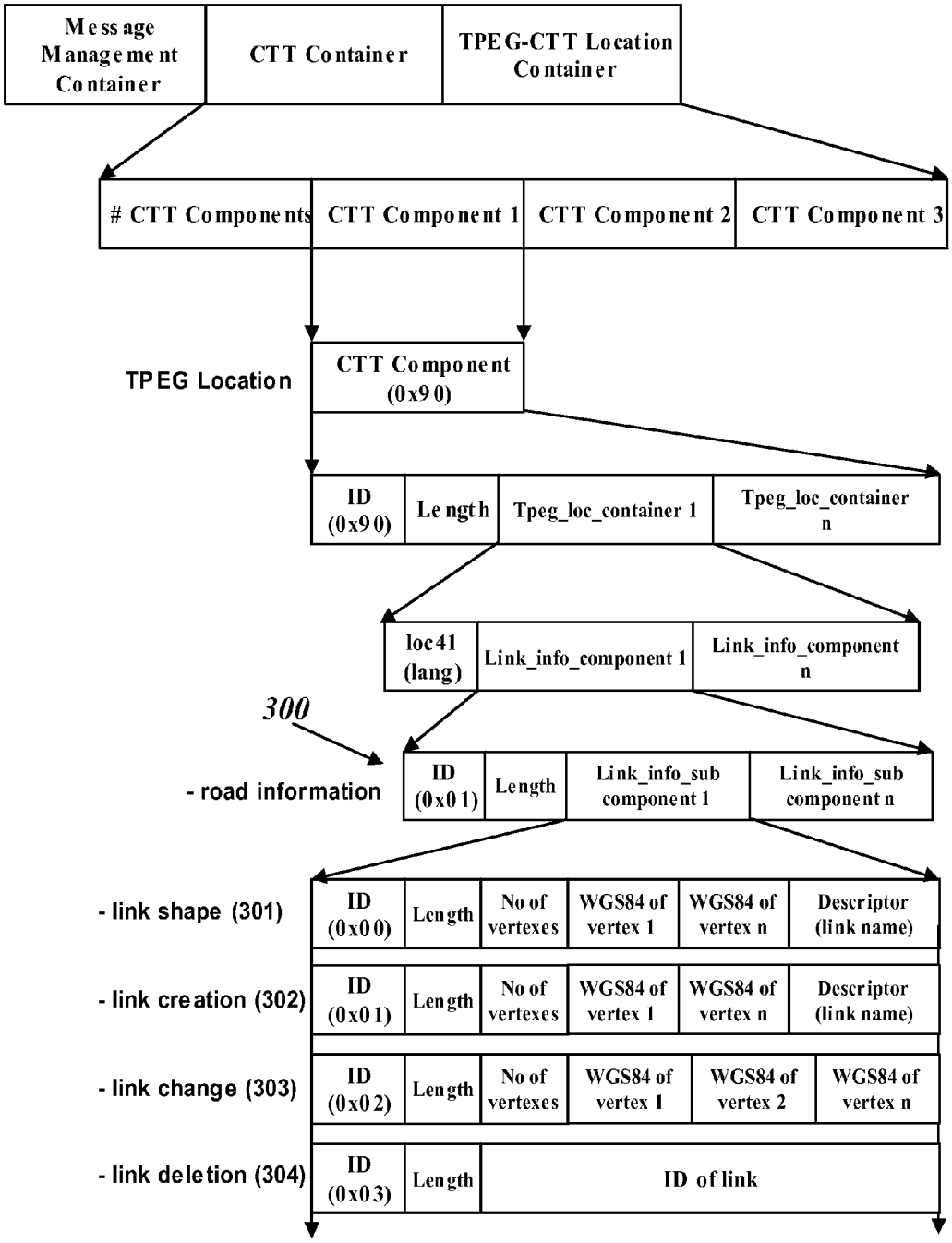
FIG. 3B illustrates a transmission format of the congestion traffic information (TPEG-CTT) message by focusing on the road information component.

Link_info_component, as shown in FIG. 3B, may comprise a link shape sub-component 301 carrying shape information relating to a certain link, a link creation sub-component 302 carrying information relating to a new link, a link change sub-component 303 for changing the shape of the existing link, and a link elimination sub-component 304 for removing a link. It is to be understood that the road information component may comprise other sub-components.

In various implementations, the link shape sub-component 301 has an ID of 0×00 and comprises an ID of the link, the number of link vertices, information relating to the vertices, and a name assigned to the link. The vertex is information consisting of a pair of latitude and longitude which may be defined, for example, in the WGS 84 format, so that the traffic information receiving terminal may recognize the shape of the link and display the graphical representation according to the recognized shape. The link shape sub-component 301 may be provided to help the traffic information receiving terminal including no electronic map to represent a more accurate shape of the road based on the current location on the screen. Thus, the number of the vertices included in the link shape sub-component 301 may be enough to reveal the shape of the road when the road is presented according to the VGA or the QVGA on a scale lower than the precision of the electronic map supplied from a disk medium, for example, on a reduced scale of 1 to 10000.

The link creation sub-component 302 has 0×01 as its ID and may comprise an ID of the link to be newly assigned, the number of link vertices, information relating to the vertices, and the number assigned to the link. The link creation sub-component 302 may be generated and provided when a road link is newly built.

The link change sub-component 303 has 0×02 as its ID and may comprise an ID of the link, the number of link vertices, and information relating to the vertices. The link change sub-component 303 may be generated and provided when the shape of an existing road link is changed, for example, when the road shape is changed by linearizing the curved section. Since the link change sub-component 303 may provide information relating to the shape change of the existing road link, the same link ID as previously assigned to the link may be utilized and the sub-component 303 need not include a link name.

The link elimination sub-component 304 has 0×03 as its ID. In FIG. 3B, although the link elimination sub-component 304 may include a length field, the length field may be omitted since the link ID has a fixed length. The link elimination sub-component 304 may comprise a link ID to be deleted, and may be generated and provided in relating to a closed link for a long term due to construction and expansion of the road.

The server 100 may configure the current congestion traffic information, as shown in FIGS. 2A through 2C, according to the traffic information aggregated through various paths and its stored traffic information database and may transmit the configured congestion traffic information to the traffic information receiving terminal by radio. Additionally, according to road change information, the sub-components 301 through 304 may be generated and loaded into the road information component 300 to transmit.

In various implementations, after transmitting the information relating to the road change, traffic flow information, such as average speed, link travel-time, congestion type, and so on, relating to the new road link and the changed road link, is transmitted in the same manner as other links.

In various implementations, the information on link shape provided through the aforementioned link shape sub-component 301, may be provided for a terminal in different manner. For example, the vertex information about link shape may be carried by the aforementioned coordinates component as shown in FIG. 3C. The coordinates component 310 carrying vertex information has ID of 0×02 to distinguish from coordinates component (e.g., road-type list shown in FIG. 2C, etc.) carrying other information.

Coordinates information describing road shape may be transmitted in a vertex component as shown in FIG. 3C, and each vertex component includes ID of 0×00 indicative of vertex component and sequence number (seq. no) indicative of order of vertex.

FIG. 3D shows structures of the vertex component and the coordinates component carrying vertex information about link shape.

In the implementation of FIG. 3C, the coordinates component 310 carrying vertex information may not have identification information on a link to which the vertex information is applied. Instead, link identifying information may be carried by a link component included in the link identifying information component (a coordinates component whose ID is 0×10 ) as shown in FIG. 2C. The association there between may be made by, for example, placed order in a coordinates component. That is, a link ID carried by the first link component may be associated with the first link vertex coordinates component, and another link ID carried by the second link component may be associated with the second link vertex coordinates component.

Figure 4:
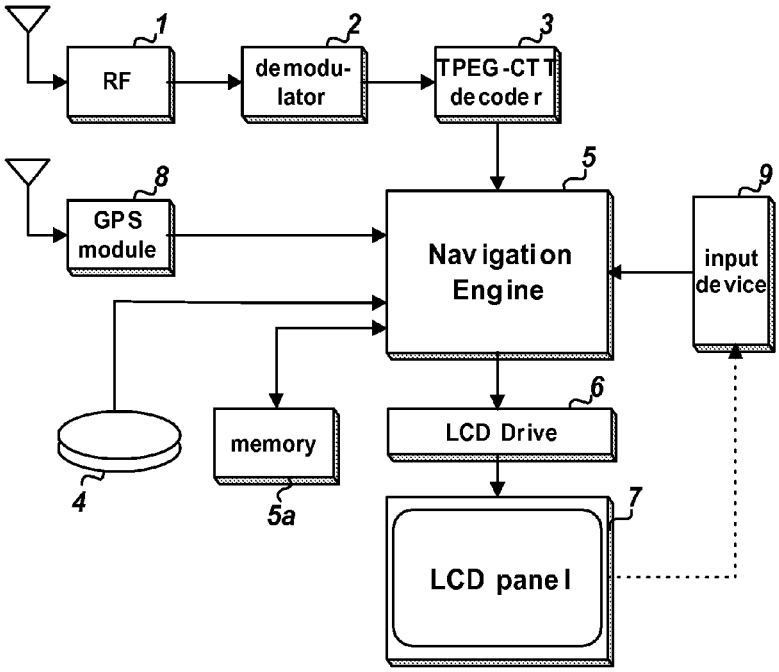
FIG. 4 illustrates a structure of a navigation terminal installed to a vehicle.
Figure 5:
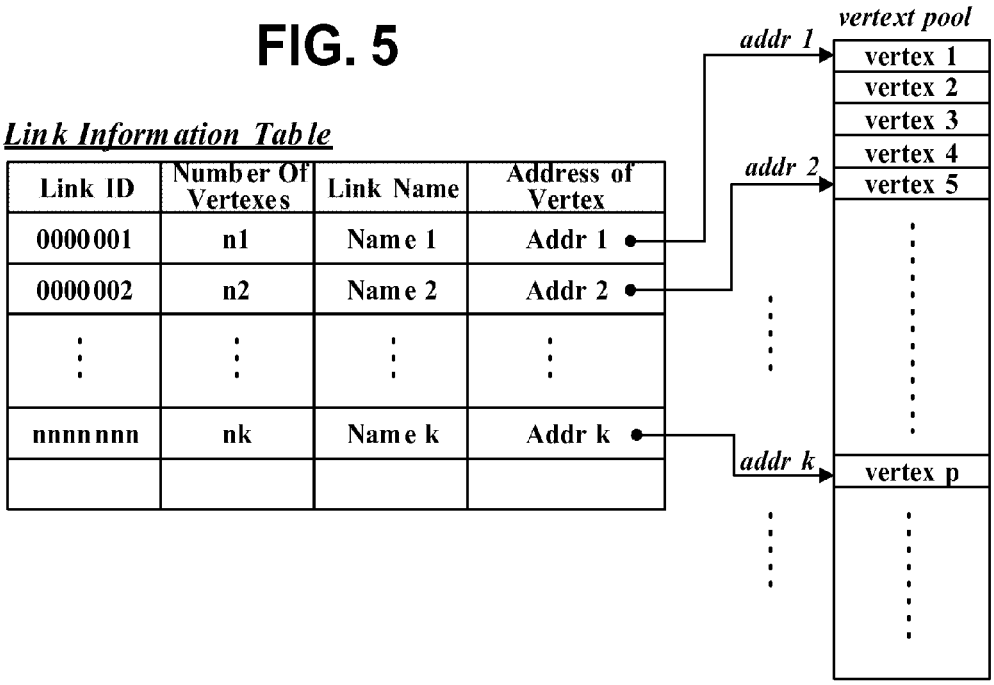
FIG. 5 illustrates an exemplary structure of a link information table organized based on information included in the received road information component.

FIGS. 4-6 illustrates exemplary implementation of a system for receiving and utilizing traffic information. Other systems may be organized differently or include different components. Specifically, FIG. 4 illustrates a structure of a navigation terminal installed to a vehicle for receiving traffic information from the server 100.

In FIG. 4, the navigation terminal comprises a tuner 1 tuning to a signal band of the traffic information transmission and outputting a modulated signal, a demodulator 2 outputting a traffic information signal by demodulating the modulated traffic information signal, a TPEG-CTT decoder 3 acquiring various traffic information by decoding the demodulated traffic information signal, a global positioning system (GPS) module 8 acquiring the current location (longitude, latitude, and height) by receiving satellite signals from a plurality of low earth orbit satellites, a storage structure 4 storing various graphic information, an input part 9 receiving a user's input, a navigation engine 5 controlling a screen output based on the user's input, the current location, and the acquired traffic information, a memory 5*a* temporarily storing necessary information, a liquid crystal display (LCD) panel 7 displaying image, and an LCD drive 6 applying a driving signal according to a graphic to be displayed to the LCD panel 7. The input part 9 may be a touch screen on the LCD panel 7. To ease the understanding, it is assumed that the storage structure 4 is or is not provided with the electronic map including information relating to links and nodes.

The tuner 1 tunes the signal received at the server 100. The modulator 2 demodulates and outputs the tuned signal according to a preset scheme. Next, the TPEG-CTT decoder 3 extracts the TPEG message, as shown in FIGS. 2A through 2I and FIGS. 3A and 3B or FIGS. 3C and 3D, from the demodulated signal and temporarily stores the extracted message. The temporarily stored TPEG message is analyzed and thus necessary information and/or control data according to the message content is provided to the navigation engine 5. Although the various information and/or the control data are transferred from the TPEG-CTT decoder 3 to the navigation engine 5, for purposes of brevity, the following descriptions focuses on how to process the road shape and the road change information, though other information is involved.

The TPEG-CTT decoder 3 extracts the date/time, and the message generation time in the message management container of the TPEG message and checks whether a subsequent container is a CTT event container based on the information of a 'message element' (i.e. an identifier). When the subsequent container is the CTT event container, the information acquired from the CTT container in the CTT event container is provided so that the navigation engine 5 may perform the display operation according to the traffic flow information and the road information, to be explained below. Providing the navigation engine 250 with the information may include determining, based on identifiers, that the traffic information includes a message management container including status or vertex information within various message components within the message management container. The components may each include different status or vertex information associated with different links or locations and identifiers associated with the different status or vertex information. The containers and components may each include information associated with a generation time, version number, data length, and identifiers of included information.

Location information corresponding to current traffic flow information is acquired from the subsequent TPEG-CTT location container. This location information may include location coordinates such as longitude and latitude of a start point and an end point according to the type information of the TPEG-CTT location container, or the link, i.e., the link ID assigned to the road link. If a storage structure 4 is equipped, a link corresponding to the received information may be specified based on the information relating to the links and the nodes stored in the storage structure 4. The navigation engine 5 may convert the location coordinates of the received link to the link ID or vice versa.

In the implementation of FIG. 3B, the TPEG-CTT decoder 3 checks whether the road information component including the ID of 0×01 is received in the TPEG-CTT location sub-container Tpeg_loc_container. When the road information component is present, the TPEG decoder 3 detects sub-components from the road information component and provides information included in the sub-components to the navigation engine 5. If the detected sub-components are link shape sub-components including the ID of 0×00 and the terminal in FIG. 4 stores the electronic map in the storage structure 4, the information included in the sub-components may be ignored by the navigation engine 5.

In the implementation of FIG. 3C, the vertex information on link shape is extracted from the coordinates component including ID of 0×02 included in the location component including ID of 0×00, and the extracted vertex information may be sent to the navigation engine 5 or discarded.

If the storage structure 4 does not store the electronic map, the navigation engine 5 may store the information of the received link shape sub-components in the link information table, as shown in FIG. 5, of the memory 5*a*. In doing so, the vertex information may be separately stored in a vertex pool and a location address addr k of a start vertex of the stored vertices may be recorded to a corresponding entry of the link information table.

When the electronic map is embedded in the storage structure 4, the navigation engine 5 may read out a necessary area (an area around the current location) on the electronic map based the current location coordinates received from the GPS module 8 and displays the area on the LCD panel 7 via the LCD drive 6. In doing so, the place corresponding to the current location may be marked by a specific graphic symbol. When the storage structure 4 does not have the electronic map, the navigation engine 5 may control the LCD drive 6 to display the road shape as the graphical presentation on the LCD panel 7 according to the vertex information with respect to the links belonging to the area around the current location in the link information table stored in the memory 5*a* as show in FIG. 5. The links belonging to the current area may be confirmed based on the vertex information of the links.

If the detected sub-components are link creation sub-components including the ID of 0×01 or link change sub-components including the ID of 0×02, the navigation engine 5 may store the information which is included in the sub-components and received from the TPEG-CTT decoder 3, in the link information table as constructed in FIG. 5, regardless of the electronic map embedded in the storage structure 4. If there is an entry including the same link ID, the information may be stored by substituting the entry.

If the detected sub-components are link elimination components including the ID of 0×03, the TPEG-CTT decoder 3 may request the navigation engine 5 to issue an elimination request command of the link including the ID identical to the link ID of the sub-components. When the electronic map is not provided, the navigation engine 5 may control deletion of the entry of the corresponding link from the link information table in the memory 5*a*. When the electronic map is provided, the navigation engine 5 may search an entry including the corresponding link ID in the link information table of the memory 5*a*. If such an entry is discovered, the entry may be deleted from the link information table of FIG. 5. If the entry is not discovered, the entry may be recorded in a separate deleted link table in the memory 5A. The deleted link table arranges IDs of the deleted links.

The navigation engine 5 controls the display of the traffic flow information received from the TPEG-CTT decoder 3, e.g., the link average speed or the link average travel-time in the displayed area according to the location coordinates of the link ID included in the coordinates component corresponding to the status component which carries the traffic flow information, within the subsequent location container. The link corresponding to the location coordinates or the link ID received in the location container may be retrieved from the memory 5*a*. When the storing structure 4 stores the electronic map and the corresponding link is not discovered in the memory 5*a*, the retrieval in the storage structure 4 may be conducted. In case of the terminal including the electronic map, since entries of the link information table stored in the memory 5*a* may be first retrieved, the link including the information based on the latest road conditions may be specified earlier than the electronic map of the storage map 4.

As such, the new link or the changed link and the general link may be specified. The traffic flow information as to the specified link is acquired from the corresponding status component with the CTT component which carries the traffic information and has the ID of 0×80 as mentioned above.

Figure 6A:
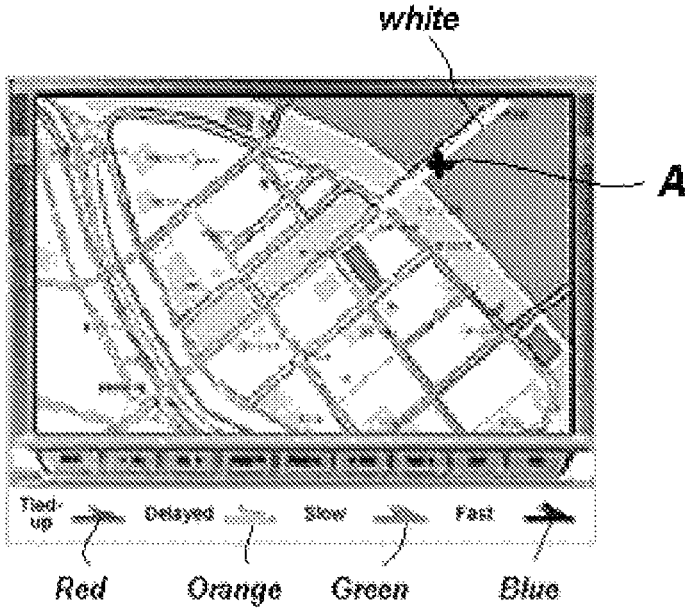
FIGS. 6A through 6C illustrate graphical user interfaces corresponding to various modes displaying the road links and the speed in the road links.
Figure 6B:
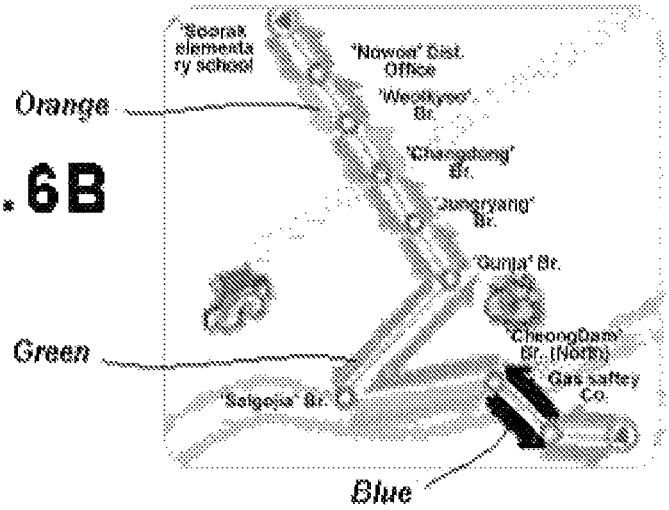
Figure 6C:
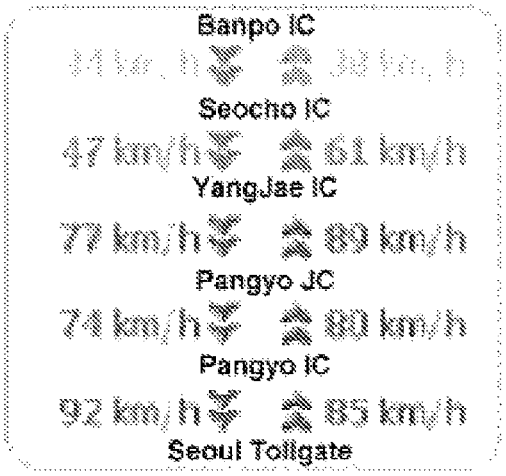

The navigation engine 5 may display the traffic flow information, e.g., the average speed on the path by changing a color according to the link average speed as shown in FIGS. 6A and 6B or by indicating a number to the corresponding link as shown in FIG. 6C. For example, as for the ordinary road, the red denotes 0~10 km/h, the orange denotes 10~20 km/h, the green denotes 20~40 km/h, and the blue denotes more than 40 km/h. Particularly, FIG. 6A depicts a case when the terminal of FIG. 4 is equipped with the electronic map, FIG. 6B depicts a case when the electronic map is not provided and the LCD drive 6 and the LCD panel 7 support the graphical representation, and FIG. 6C depicts a case when the electronic map is not provided and the LCD drive 6 and the LCD panel 7 support only the text representation.

Referring to FIG. 6A, the new road link or the changed road link may be displayed according to the vertex information of the corresponding link stored in the link information table stored in the memory 5*a*. In FIG. 6B, links may be displayed on the screen according to the vertex information of the links organized in the link information table of the memory 5*a*. In the case in which the electronic map is provided and a link belonging to the currently displayed link is included in the deleted link table of the memory 5*a*, the link may not be displayed on the screen. Alternatively, as indicated by mark 'A' in FIG. 6A, a specific mark indicative of the shut-down may be displayed on the displayed road and thus the traffic flow information on the blocked road may not be displayed. In FIG. 6A, the relevant link is displayed in the white rather than in the red, the orange, the green, and the blue that indicate the average speed.

Meanwhile, in case that the navigation engine 5 has a path search function with respect to the destination, it is possible to automatically search or re-search a desired path based on the received link average speed or link average travel-time when the user's request is specified or the destination is designated. A terminal without the electronic map may determine and may display the path on the screen based on the links in the link information table registered to the memory 5*a* and the received traffic flow information relating to the links. Note that the received traffic flow information of the links may be stored in the memory 5*a* until it is updated by the next traffic flow information. A terminal with the electronic map may determine a path based on the traffic flow information relating to the links of the link information table registered in the memory 5*a* and the traffic flow information relating to the link information on the electronic map of the storage structure 4. As for a link including the same link ID, the link in the link information table may be selected. Next, a determination may be made whether the links along the selected path are organized in the deleted link table of the memory 5*a*. When they are not in the deleted link table, the selected path may be confirmed. Otherwise, when the links along the selected path are in the deleted link table, a partial path including the links may be excluded and the whole path may be determined by conducting the re-search in relation to the partial path. As a result, the determined path may be displayed on the map of the screen.

If the terminal of FIG. 4 is equipped with a voice output means, it the terminal may output the received traffic flow information relating to the links on the determined path as the voice. Also, in a case in which a blocked road, that is, the link recorded in the deleted link table appears in front of the path during the driving, a voice such as "a 'certain road' ahead is shut down" may be output. Note that the 'certain road' may correspond to the deleted link ID and that the output voice may be a complex sound corresponding to the link name in the link information on the electronic map.

The foregoing description has been presented for purposes of illustration. Thus, various implementations with improvements, modifications, substitutions, or additions within the spirit and scope as defined by the following appended claims.

What is claimed is:

1. A method of processing traffic information, comprising:

receiving, at a device with at least one processor, a traffic information including at least one traffic information message including:

a road information corresponding to a predetermined road, wherein the road information includes a location information of the predetermined road;

a first identifier identifying whether the road information is included in the traffic information message;

vertex information for indicating a shape of the predetermined road, wherein the vertex information includes one or more vertex components that indicate a position along the predetermined road;

a second identifier identifying whether the vertex information is included in the traffic information message; and a traffic information component including speed information for the predetermined road;

decoding, by the device with at least one processor, the received traffic information message, and displaying, on a map, at least a portion of the predetermined road including one or more of the vertex components, wherein the traffic information further includes number information indicating a number of the traffic information message.

2. The method of claim 1, wherein the traffic information message includes an indicator of a number of vertex components that are specified by the vertex information wherein the number of vertex components included in the vertex information corresponds to the number of vertex components indicated by the indicator.

3. The method of claim 2, wherein the received indicator specifies that the vertex information includes only one vertice, and the identified one or more vertex components consists of a single vertex component that reveals a single position along the predetermined road.

4. The method of claim 2, wherein the received indicator specifies that the vertex information includes more than one vertice, and the identified one or more vertex components includes multiple vertex components that correspondingly reveal multiple positions along the predetermined road.

5. The method of claim 4, wherein the identified one or more vertex components are each associated with a sequence value configured to order the vertex components along the predetermined road.

6. The method of claim 4, wherein the vertex information includes the sequence value.

7. The method of claim 1, wherein the traffic information message includes information corresponding to a message management structure including information corresponding to a generation time of information reflected in the vertex information.

8. The method of claim 7, wherein the generation time included within the received message management structure relates to a plurality of vertex components.

9. The method of claim 8, wherein the generation time included within the received message management structure relates to a plurality of message component structures that correspond to a vertex component.

10. The method of claim 9, wherein each message component structure further comprises an identifier specific to the type of information included in the message management structure.

11. The method of claim 10, wherein the one or more vertex components include, for each vertex component, a sequence value configured to order the one or more vertex components along the predetermined road.

12. The method of claim 1, wherein the one or more vertex components identify a longitude and latitude associated with a position along a predetermined road.

13. The method of claim 1, wherein the one or more vertex components include a text descriptor associated with the vertex component.

14. The method of claim 1, wherein the position is a position along the predetermined road.

15. The method of claim 1, wherein the number information indicates the number of the traffic information message with respect to a sequence of traffic information messages included in a traffic component frame.

16. A method of processing traffic information at a receiver, comprising:

receiving a traffic information including at least one traffic information message including:

a first location information of a predetermined road, a first identifier identifying whether the first location information is included in the traffic information message, second location information of a predetermined position within the predetermined road, wherein the second location information includes a longitude and latitude information of the predetermined position, a second identifier identifying whether the second location information is included in the traffic information message, and a traffic information component including a speed information for the predetermined road; and decoding the received traffic information message, displaying, on a map, at least a portion of the predetermined road, wherein the traffic information further includes number information indicating a number of the traffic information message.

17. The method of claim 16, wherein the first location information includes location information of a start point and an end position of the road.

18. A traffic information communication device, comprising:

a data receiving interface configured to receive a traffic information including at least one traffic information message including:

a road information corresponding to a predetermined road, wherein the road information includes a location information of the predetermined road, a first identifier identifying whether the road information is included in the traffic information message, vertex information for indicating a shape of the predetermined road, wherein the vertex information includes one or more vertex components that indicate a position along the predetermined road, a second identifier identifying whether the vertex information is included in the traffic information message, and a traffic information component including speed information for the predetermined road;

a decoding device configured to decode the traffic information message, and a displaying device configured to display, on a map, at least a portion of the predetermined road including one or more of the vertex components, wherein the traffic information further includes number information indicating a number of the traffic information message.

19. The device of claim 18, wherein the position along the predetermined road is a position along a path other than the shortest path between endpoints of the predetermined road.

20. The device of claim 18, wherein a vertex component of the one or more vertex components includes vertex position information that corresponds to at least a two-dimensional position where at least one positional dimension corresponds to time.

21. The device of claim 20, wherein a set of values corresponding to the first dimension is a function of a set of values corresponding to time.

22. The device of claim 18, wherein a vertex component of the one or more vertex components includes vertex position information that corresponds to more than a two-dimensional position, wherein, one dimension is associated with elevation.

23. The device of claim 18, wherein the decoding device is configured to decode information identifying a longitude of the vertex position and information identifying a latitude of the vertex position.

24. The device of claim 18, wherein the vertex information includes a data length of information used to reveal the vertex position along the predetermined road.

25. The device of claim 18, wherein the decoding device is configured to determine a vertex position from information other than longitude, latitude, or sequence.

26. The device of claim 18, wherein the vertex information further includes information corresponding to a version number of information reflected in the vertex information, wherein the version number is associated with a specific syntax of the data where any one of multiple syntaxes may be used.

27. The device of claim 18, wherein the traffic information message further includes information corresponding to a message management structure including information corresponding to a generation time of information reflected in the vertex information.

28. The device of claim 18, wherein the position is a position along the predetermined road other than a start point or an end point of the predetermined road.

* * * * *